US005405499A

United States Patent [19]

Vinson

[11] Patent Number: 5,405,499

[45] Date of Patent: Apr. 11, 1995

[54] CELLULOSE PULPS HAVING IMPROVED SOFTNESS POTENTIAL

[75] Inventor: Kenneth D. Vinson, Germantown, Tenn.

[73] Assignee: The Procter & Gamble Company, Cincinnati, Ohio

[21] Appl. No.: 82,683

[22] Filed: Jun. 24, 1993

[51] Int. Cl.[6] ..... D21H 11/00

[52] U.S. Cl. ..... 162/100; 162/4; 162/55; 162/147; 162/149

[58] Field of Search ..... 162/55, 4, 100, 147, 162/149

[56] References Cited

U.S. PATENT DOCUMENTS

| | | | |
|---|---|---|---|
| 1,951,017 | 3/1934 | Hatch | 92/20 |
| 2,947,655 | 8/1960 | Eberhardt | 162/26 |
| 3,016,324 | 1/1962 | Textor | 162/24 |
| 3,041,246 | 6/1962 | Bolaski et al. | 195/8 |
| 3,085,927 | 4/1963 | Pesch | 162/55 |
| 3,301,745 | 1/1967 | Coppick et al. | 162/55 |
| 3,352,745 | 11/1967 | Malm | 162/55 |
| 3,406,089 | 10/1968 | Yerkes, Jr. | 162/199 |
| 3,441,130 | 4/1969 | Sisson et al. | 209/2 |
| 3,791,917 | 2/1974 | Bolton, III | 162/55 |
| 4,292,122 | 9/1981 | Karnis et al. | 162/28 |
| 4,334,984 | 6/1982 | Vagac et al. | 209/3 |
| 4,435,249 | 3/1984 | Markham et al. | 162/24 |
| 4,504,016 | 3/1985 | Wikdahl | 241/24 |
| 4,562,969 | 1/1986 | Lindahl | 241/21 |
| 4,599,138 | 7/1986 | Lindahl | 162/19 |
| 4,731,160 | 3/1988 | Prough et al. | 162/55 |
| 4,776,926 | 10/1988 | Lindahl | 162/28 |
| 4,874,465 | 10/1989 | Cochrane et al. | 162/111 |
| 4,888,092 | 12/1989 | Prusas et al. | 162/130 |
| 4,915,821 | 4/1990 | Lamort | 209/17 |
| 4,923,565 | 5/1990 | Fuentes et al. | 162/72 |
| 4,938,843 | 7/1990 | Lindhal | 162/55 |
| 4,985,119 | 1/1991 | Vinson et al. | 162/149 |
| 5,112,444 | 5/1992 | Henricson et al. | 162/55 |
| 5,145,010 | 9/1992 | Danielsson et al. | 162/26 |
| 5,147,504 | 9/1992 | Henricson et al. | 162/55 |
| 5,228,954 | 7/1993 | Vinson et al. | 162/100 |

FOREIGN PATENT DOCUMENTS

0568404A1 11/1993 European Pat. Off. .

*Primary Examiner*—W. Gary Jones
*Assistant Examiner*—Dean T. Nguyen
*Attorney, Agent, or Firm*—Gerry S. Gressel; Bart S. Hersko; Larry L. Huston

[57] ABSTRACT

Cellulosic pulps of selected fiber morphology are disclosed having a coarseness less than a threshold coarseness level. The threshold coarseness level is a function of average fiber length. The cellulosic pulps are especially useful for producing paper structures such as tissue paper. A method for producing the cellulosic pulps is also disclosed.

8 Claims, 1 Drawing Sheet

CELLULOSE PULPS HAVING IMPROVED SOFTNESS POTENTIAL

This patent application cross-references allowed and commonly assigned U.S. patent application Ser. No. 07/705,845, U.S. Pat. No. 5,228,954, "Cellulose Pulps of Selected Morphology For Improved Paper Strength Potential" filed May 28, 1991 in the name of Vinson et al.

TECHNICAL FIELD

This invention is related to cellulose pulps and more specifically to cellulose pulps having reduced coarseness with respect to the average pulp fiber length.

BACKGROUND OF THE INVENTION

Softness is an important attribute of tissue paper products. Consumers perceive soft tissue products as tactilely pleasant against the skin, and therefore desirable. Manufacturers of tissue products therefore seek to improve the perceived softness of tissue products to increase sales.

Tissue products are typically formed, at least in part, from cellulosic pulps containing wood fibers. Those skilled in the art recognize that the perceived softness of a tissue product formed from such pulps is related to the coarseness of pulp fibers. Pulps having fibers with low coarseness are desirable because tissue paper made from fibers having a low coarseness can be made softer than similar tissue paper made from fibers having a high coarseness.

Fiber coarseness generally increases as fiber length and fiber surface area increase. The softness of tissue products can be improved by forming the tissue products from pulps comprising only short fibers. Unfortunately, tissue paper strength generally decreases as the average fiber length is reduced. Therefore, simply reducing the pulp average fiber length can result in an undesirable trade-off between product softness and product strength.

Another method for reducing the coarseness of fibers comprises lengthwise slicing individual fibers with a sliding microtome. Slicing fibers lengthwise reduces the fiber weight per unit fiber length and alters the naturally occurring closed fiber wall cross-section to an open fiber wall cross-section. Such a method is disclosed in U.S. Pat. No. 4,874,465 issued Oct. 17, 1989 to Cochrane et al. Slicing fibers lengthwise requires meticulous processing and is not considered to be a commercially feasible method of providing the quantities of fibers needed for making tissue products.

Tissue products having improved softness can also be formed from pulps comprising fibers from selected species of hardwood trees. Hardwood fibers are generally less coarse than softwood fibers. For example, those skilled in the art recognize that bleached kraft pulps made from eucalyptus contain fibers of relatively low coarseness and can be used to improve the perceived softness of tissue products.

Unfortunately, virgin kraft pulps made from a single species such as eucalyptus are in relatively limited supply and are therefore more expensive than certain pulps which tend to comprise fibers generally having inferior coarseness properties. Examples include pulps which are derived by mechanical pulping regardless of the source species and recycled pulps which invariably contain a mixture of fiber types and species. The concern over the depletion of the world's forest reserve has increased interest in utilizing such recycled pulps. Recycled pulps typically contain a blend of hardwood and softwood fibers from a variety of species. Such blends are particularly prone to having relatively high coarseness compared to their average fiber length.

In addition to inferior coarseness, the above-mentioned fiber blends often suffer from an undesirable non-uniformity in fiber properties. For example, it is believed that one of the advantages of the bleached kraft pulp made from eucalyptus is that it tends to be highly uniform in coarseness in addition to having a desirable average coarseness. One index of the distribution of coarseness within a specimen of pulp fibers can be obtained by measuring and ranking the specimen fibers by fiber surface area to obtain a group of fibers within the pulp specimen comprising the largest one percent of fibers in the specimen. The surface area of the smallest surface area fiber in this group, referred to as the minimum fiber surface area, provides an index of the coarseness distribution in the pulp specimen. A comparatively low value of this minimum fiber surface area indicates that the pulp specimen is relatively uniform with respect to coarseness. A comparatively high value of the minimum fiber surface area indicates that the pulp specimen is relatively non-uniform and will be less desirable for the application at hand even if the average coarseness of the specimen is in a desirable range.

In addition, it is necessary to consider the relative content of hardwood and softwood in judging whether a particular pulp specimen has a comparatively low or high value of minimum fiber surface area. A technique for determining whether a particular sample has a comparatively high or low value of minimum fiber surface area is discussed in the specification. The measured minimum fiber surface area can be reduced by a scale factor for each percentage of softwood in the pulp specimen. This reduced minimum fiber surface area is referred to as the pulp incremental surface area. A pulp specimen having a value of incremental surface area below a threshold level is considered to be uniform with respect to coarseness.

The papermaker who is able to obtain pulps having a desirable combination of fiber length and coarseness from fiber blends generally regarded as inferior with respect to average coarseness and uniformity of fiber properties may reap significant cost savings and/or product improvements. For example, the papermaker may wish to make a tissue paper of superior strength without incurring the usual degradation in softness which accompanies higher strength. Alternatively, the papermaker may wish a higher degree of paper surface bonding to reduce the release of free fibers without suffering the usual decrease in softness which accompanies greater bonding of surface fibers.

Accordingly, one object of the present invention is to provide a cellulose pulp having a fiber coarseness less than a threshold coarseness level.

Another object of the present invention is to provide a cellulose pulp comprising a blend of softwood and hardwood fibers and having a desirable combination of fiber length and fiber coarseness.

Still another object of the present invention is to provide a method for producing a cellulose pulp having a desirable combination of fiber length and fiber coarseness.

These and other objects are obtained using the present invention, as will be seen from the following disclosure.

All percentages, ratios, and proportions herein are by weight, unless otherwise specified. All fiber weight percentages are dry weight percentages unless otherwise specified.

SUMMARY OF THE INVENTION

The present invention comprises a cellulose pulp including wood fibers of selected morphology and having low coarseness with respect to the pulp average fiber length. The cellulose pulp comprises at least ten percent softwood fibers. The cellulose pulp also has a fiber incremental surface area less than 0.085 square millimeters and a fiber coarseness that is related to the average fiber length by the relation:

$$C<(L)^{0.3}+0.3$$

wherein C is the fiber coarseness measured in milligrams of fiber weight per 10 meters of fiber length, and L is the average fiber length in millimeters. The cellulose pulp can comprise recycled hardwood and softwood chemical pulp fibers.

The present invention also comprises a method of forming cellulose pulps having low coarseness with respect to the pulp average fiber length. The method provides two fractionation stages: a length classification stage and a centrifuging stage. Each fractionation stage includes an input stream, an accepts stream, and a rejects stream. At least a portion of the accepts stream of one of the fractionation stages forms the input stream to the other fraction stage.

The length classification stage comprises processing the input stream to the length classification stage to provide a length classification stage accepts stream having an average fiber length which is at least 20 percent less than the average fiber length of the rejects stream of the length classification stage. The centrifuging stage comprises processing the input stream to the centrifuging stage to provide the centrifuging stage accepts stream having fibers with a normalized fiber coarseness at least 3 percent, and preferably at least 10 percent less than the normalized fiber coarseness of the fibers in the rejects stream of the centrifuging stage.

The method also comprises processing the input streams of each fractionation stage to provide an accepts stream of each fractionation stage having a fiber weight of between 30 percent and 70 percent of the fiber weight of the respective input stream.

DETAILED DESCRIPTION OF THE INVENTION

Figure 1:
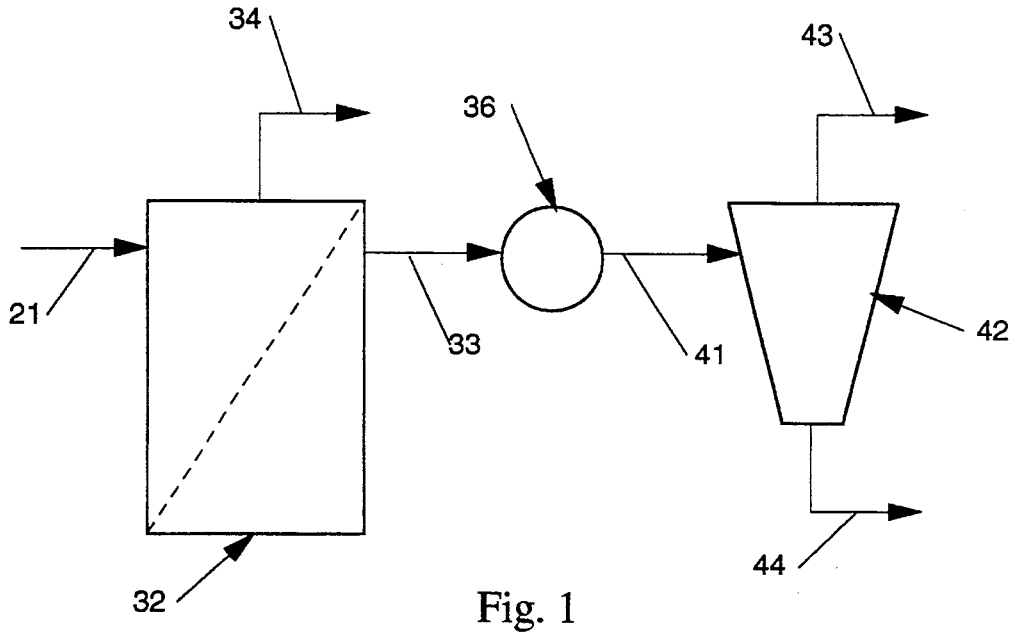
FIG. 1 is a schematic flow diagram depicting one method of practicing the current invention wherein a length classifying stage is performed first, followed by a centrifuging stage.

The present invention comprises a cellulose pulp including wood fibers of selected morphology. The cellulose pulp has a low coarseness for a particular pulp average fiber length despite containing relatively high proportions of softwood fibers. Specifically, the cellulose pulp comprises at least 10 percent softwood fibers, has an incremental surface area less than 0.085 square millimeters, and is characterized by having a coarseness related to the average fiber length by the condition:

$$C<L^{0.3}+0.3$$

where C is the coarseness in milligrams of fiber weight per ten meters of fiber length (mg/10 m) and L is the average fiber length measured in millimeters (mm). The cellulose pulp preferably comprises wood fibers having an average fiber length between about 0.70 mm to about 1.1 mm, and more preferably about 0.75 mm to about 0.95 mm. The cellulose pulp can comprise chemical pulp fibers and in one preferred embodiment comprises recycled paper fibers, such as recycled ledger paper fibers.

The present invention also comprises a method of selecting fiber morphologies having a favorable combination of coarseness and fiber length. The method comprises two fractionation stages and comprises the following steps: providing an aqueous slurry comprising wood pulp fibers; providing a first fractionation stage comprising one of a length classification stage and centrifuging stage; directing at least a portion of the slurry to form an input stream to the first fractionation stage; processing the input stream to the first fractionation stage to provide an accepts stream of the first fractionation stage; providing a second fractionation stage comprising the other of a length classification stage and a centrifuging stage; directing at least a portion of the accepts stream from the first fractionation stage to provide an input stream to the second fractionation stage; processing the input stream to the second fractionation stage to provide an accepts stream of the second fractionation stage. The input stream to the length classification stage is processed to provide a length classification stage accepts stream having an average fiber length which is at least 20 percent less than the average fiber length of the rejects stream of the length classification stage. The input stream to the centrifuging stage is processed to provide a centrifuging stage accepts stream having fibers with a normalized fiber coarseness at least 3 percent, and preferably at least 10 percent less than the normalized fiber coarseness of the fibers in the rejects stream of the centrifuging stage.

DEFINITIONS

As used herein, the term "morphology" refers to the various physical characteristics of wood fibers including fiber length, fiber width, surface area, cell wall thickness and cell wall geometry, coarseness, and the like. The term "selected morphology" refers to fibers having a generally closed cell wall geometry, as distinguished from fibers which are lengthwise sliced or otherwise altered to have an open cell wall geometry. The term "selected morphology" further refers to fibers which have been selected from the general class of fibers to provide an enhanced combination of coarseness and fiber length within the domain of fibers possessing a certain combination of species which would otherwise relegate them to lesser uses by papermakers.

As used herein, the term "length classifying" refers to the process of dividing an aqueous slurry of cellulosic fibers into at least two output slurries consisting of cellulose fibers differing in average fiber length and other characteristics intrinsic to the length difference. Typically, length classifying is accomplished by passing the input slurry through a perforated barrier to separate shorter fibers, which have a greater probability of passing through the perforations, from longer fibers.

The term "average fiber length," abbreviated as "L" in the algebraic formulae contained herein, refers to the length weighted average fiber length as determined with a suitable fiber length analysis instrument such as a Kajaani Model FS-200 fiber analyzer available from Kajaani Electronics of Norcross, Ga. The analyzer is operated according to the manufacturer's recommendations with the report range set at 0 mm to 7.2 mm and the profile set to exclude fibers less than 0.2 mm in length from the calculation of fiber length and coarseness. Particles of this size are excluded from the calculation because it is believed that they consist largely of non-fiber fragments which are not functional for the uses toward which the present invention are directed.

The term "coarseness", abbreviated "C" in the algebraic formulae contained herein, refers to the fiber mass per unit of unweighted fiber length reported in units of milligrams per ten meters of unweighted fiber length (mg/10 m) as measured using a suitable fiber coarseness measuring device such as the above mentioned Kajaani FS-200 analyzer. The coarseness C of the pulp is an average of three coarseness measurements of three fiber specimens taken from the pulp. The operation of the analyzer for measuring coarseness is similar to the operation for measuring fiber length. Care must be taken in sample preparation to assure an accurate sample weight is entered into the instrument.

An acceptable method is to dry two aluminum weighing dishes for each fiber specimen in a drying oven for thirty minutes at 110 degrees C. The dishes are then placed in a desiccator having a suitable desiccant such as anhydrous calcium sulfate for at least fifteen minutes to cool. The dishes should be handled with tweezers to avoid contaminating them with oil or moisture. The two dishes are taken out of the desiccator and immediately weighed together to the nearest 0.0001 gram.

Approximately one gram of a fiber specimen is placed in one of the dishes, and the two dishes (one empty) are,placed uncovered in the drying oven for a period of at least sixty minutes at 110 degrees C. to obtain a bone dry fiber specimen. The dish with the fiber specimen is then covered with the empty dish prior to removing the dishes from the oven. The dishes and specimen are then removed from the oven and placed in a desiccator for at least 15 minutes to cool. The covered specimen is removed and immediately weighed with the dishes to within 0.0001 gram. The previously obtained weight of the dishes can be subtracted from this weight to obtain the weight of the bone dry fiber specimen. This weight of fiber is referred to as the initial sample weight.

An empty 30 liter container is prepared by cleaning it and weighing it on a scale capable of at least 25 kilograms capacity with 0.01 gram accuracy. A standard TAPPI disintegrator, such as the British disintegrator referred to in TAPPI method T205, is prepared by cleaning its container to remove all fibers. The initial sample weight of fibers is emptied into the disintegrator container, ensuring that all fibers are transferred to the disintegrator.

The fiber sample is diluted in the disintegrator with about 2 liters of water and the disintegrator is run for ten minutes. The contents of the disintegrator are washed into the 30 liter container, ensuring that all fibers are washed into the container. The sample in the 30 liter container is then diluted with water to obtain a water-fiber slurry weighing 20 kilograms, within 0.01 gram.

The sample beaker for the Kajaani FS-200 is cleaned and weighed to within 0.01 gram. The slurry in the 30 liter container is stirred with vertical and horizontal strokes, taking care to not set up a circular motion which would tend to centrifuge the fibers in the slurry. A 100.0 gram measure accurate to within 0.1 gram is transferred from the 30 liter container to the Kajaani beaker. The fiber weight in the Kajaani beaker, in milligrams, is obtained by multiplying five (5) times the initial sample weight (as recorded in grams).

This fiber weight, which is accurate to 0.01 mg, is entered into the Kajaani FS-200 profile. A minimum fiber length of 0.2 mm is entered into the Kajaani profile so that 0.2 mm is the minimum fiber length considered in the coarseness calculation. A preliminary coarseness is then calculated by the Kajaani FS-200.

The coarseness is obtained by multiplying this preliminary coarseness value by a factor corresponding to the weight weighted cumulative distribution of fibers with length greater than 0.2 mm. The FS-200 instructions provide a method for obtaining this weight weighted distribution. However, the values are reported as a percentage and are accumulated beginning at "0" fiber length. To obtain the factor described above, the "weight-weighted cumulative distribution of fibers with length less than 0.2 mm" (which is provided as an output of the instrument) is obtained from the instrument display. This display value is subtracted from 100, and the result is divided by 100 to obtain the factor corresponding to the weight weighted cumulative distribution of fibers with length greater than 0.2 mm. The resulting coarseness is therefore a measure of the coarseness of those fibers in a fiber sample having a fiber length greater than 0.2 min. The coarseness measurement is repeated, starting with oven drying two weighing dishes and a fiber specimen, to obtain three values of coarseness. The value of coarseness C used herein is obtained by averaging the three coarseness values.

The term "normalized coarseness", as used herein, is obtained by dividing the coarseness C by the average fiber length L measured in millimeters. A reduction in this ratio indicates a decrease in coarseness C with respect to average fiber length L, as compared to a simple trade-off to obtain one desirable property at the expense of another. As explained previously, relatively longer fibers are more desirable and relatively less coarse fibers are more desirable for the use toward which the present invention is directed.

The term "cellulose pulp", as used herein, refers to fibrous material derived from wood for use in making paper or other types of cellulosic products. Cellulose wood fibers from a variety of sources may be employed in the process according to the present invention. These include chemical pulps, which are pulps purified to remove substantially all of the lignin originating from the wood substance. As used herein a "chemical pulp" comprises a cellulosic pulp having a lignin content of less than 5% by weight. These chemical pulps include those made by either the sulfite or the kraft (sulfate) process. Applicable wood fibers for practicing the process of the present invention might also be derived from mechanical pulps, which as used herein, refers to wood fibers containing a substantial amount of the lignin originating in the wood substance. As such, examples of mechanical pulps include groundwood pulps, thermomechanical pulps, chemi-thermomechanical pulps, and semi-chemical pulps.

Both hardwood pulps and softwood pulps as well as blends of the two may be employed. The terms hardwood and softwood pulp as used herein refer to fibrous pulp derived from the woody substance of deciduous trees (angiosperms) and coniferous trees (gymnosperms), respectively. Also applicable to this invention are fibers derived from recycled paper, which may contain any or all of the above categories as well as minor amounts of other fibers, fillers, and adhesives used to facilitate the original papermaking.

The term "recycled paper", as used herein, generally refers to paper which has been collected with the intent of liberating its fibers and reusing them. These can be pre-consumer, such as might be generated in a paper mill or print shop, or post-consumer, such as that originating from home or office collection. Recycled papers are sorted into different grades by dealers to facilitate their reuse. One grade of recycled paper of particular value in the present invention is ledger paper. Ledger paper is usually comprised of chemical pulps and typically has a hardwood to softwood ratio of from about 1:1 to about 2:1. Examples of ledger papers include bond, book, photocopy paper, and the like.

Cellulose wood fibers from various sources may be employed to produce cellulose pulps according to the present invention. Such sources include the above mentioned chemical pulps, such as those made by the sulfate or kraft process. Fibers derived from recycled paper made with chemical pulp fibers and comprising a blend of hardwood and softwood fibers may also be employed to produce the cellulose pulps of the present invention.

The quantity "percentage softwood", as used herein, refers to the dry weight percentage of fibers in a cellulose pulp which are derived from softwood trees. The remainder of the cellulosic pulp (100% softwood) is defined as the "percentage hardwood". If unknown, the percentage softwood can be determined by optical observation by the methodology of TAPPI T401 om-88, "Fiber Analysis of Paper and Paperboard," incorporated herein by reference.

The term "minimum fiber surface area" as used herein refers to the projected surface area of the smallest surface area fiber in the group of fibers comprising the largest one percent (by surface area) of fibers in a pulp specimen. This minimum fiber surface area can be measured by image analysis as described below.

About 0.25 gm of a representative pulp specimen is moistened and shredded into pieces. The use of distilled and filtered water is recommended to reduce contaminants which would otherwise complicate image analysis. A 0.05 micron filter is sufficient to reduce such contaminants. The shredded pulp is placed in a 250 ml Erlenmeyer flask, about 50 ml of water is added, and the flask is shaken until the pulp specimen is disintegrated. The flask contents are then diluted to 200 ml volume with water. About three quarters of the flask contents are discarded, the flask is refilled to 200 ml volume, and the flask is again shaken to mix the contents. This cycle of discarding the flask contents, rediluting the flask contents, and shaking the flask is repeated until visual inspection of the flask contents indicates the resulting slurry in the flask is free of fiber to fiber contacts.

A 40×60 mm glass microscope slide is cleaned with a non-linting tissue and is prepared by marking an orthogonal grid on one surface of the slide using a permanent marker. The grid is used as a reference during the subsequent image analysis; its precise spacing is not critical and can be set at a convenient size by the operator. About one square centimeter grids are used to reduce the occurrence of fiber/grid line intersections. The slide is placed on a slide warmer, marker side "down". The slurry in the flask is shaken vigorously, and an aliquot of the slurry is removed with a disposable pipette, and deposited onto the slide. The slide should be covered with about 10 milliliters of slurry. The water on the slide is allowed to evaporate, and the surface tension is broken occasionally with a dissecting needle to prevent flocculating of the slurry fibers during the drying. Small drops of slide adhesive are placed at the four corners of a fresh slide, which is placed against the fiber-covered slide taking care not to apply excessive pressure. Excess adhesive is removed and the slide surfaces are cleaned with a non-linting tissue.

The image analysis system includes a computer having a frame grabber board, a stereoscope, a video camera, and image analysis software. A suitable frame grabber board includes a TARGA Model M8 board available from the Truevision Company, of Indianapolis, Ind. Alternatively, a Model DT2855 frame grabber board available from Data Translation of Marlboro, Mass. can be employed.

An Olympus SZH stereoscope available from the Olympus Corporation of Lake Success, N.Y., and a Kohu Model 4815-5000 solid state CCD video camera available from the Kohu Electronics Division of San Diego, Calif., can be used to acquire an image to be saved to a computer file. An Olympus Model MTV-3 adapter can be used to mount the Kohu video camera to the stereoscope. Alternatively, a VH5900 monitor microscope and a video camera having a VH50 lens with a contact type illumination head, available from the Keyence Company of Fair Lawn, N.J., can be used. The stereoscope and video camera acquire the image to be recorded. The frame grabber board converts the analog signal of this image to a digital format readable by the computer.

The image saved to the computer file is measured using suitable software such as the Optimas Image Analysis software, version 3.0, available from the BioScan Company of Edmonds, Wash. The Optimas software will run on any Windows compatible IBM PC AT or compatible computer, as well as on IBM PS/2 Microchannel systems. A suitable computer is an IBM compatible personal computer having an expansion slot for the frame grabber board, an Intel 80386 CPU, 8 megabytes of RAM, 200 megabytes of hard disk storage space, and DOS, version 3.0 or later, installed. The computer should have Windows, version 3.0 or later, installed available from the Microsoft Corporation of Redmond, Wash. Images saved to and recalled from file can be displayed on a Sony Model PVM-1271Q or Model PVM-1343MO video monitor.

The slide is placed on the stereoscope stage. The stereoscope is adjusted to a 15× magnification level. The stereoscope light source intensity is set to the maximum value, and the stereoscope aperture is set to the minimum aperture size in order to obtain the maximum image contrast. The Optimas software is run with the multiple mode set and ARAREA (area) and ARLENGTH (length) measurements selected. Under "Sampling Options," the following default values are used: sampling units are selected, set number equals 64 intervals, and minimum boundary length is 10 samples.

The following options are not selected: Remove Areas Touching Region of Interest (ROI), Remove Areas Inside Other Areas, and Smooth Boundaries. The software contrast and brightness settings are set to 0 and 170, respectively. The software threshold settings are set to 125 and 255. The image analysis software is calibrated in millimeters with a metric ruler placed in the field of view. The calibration is performed to obtain a screen width of 6.12 millimeters.

The region of interest is selected so that no fibers intersect the boundary of the region of interest. The operator positions the slide and acquires the image data (area and length) in one field. The slide is then repositioned, and image data are acquired in a second field. Data collection is continued until data from the entire slide is acquired. The use of grid lines on the slide, while not essential, is highly useful to prevent the microscopist from missing an area or reading an area more than once. Fibers crossing the grid lines are not included in the data collection.

While it is desirable to have a slide composed solely of individual fibers which do not cross, inevitably some images comprised of crossed fibers will be created. Crossed fiber images are deleted with the paint option available in the Optimas software if none of the crossed fibers are unobstructed. Unobstructed fibers in crossed fiber images are retained by painting over those fibers in the crossed fiber image which are at least partially obstructed by other fibers.

The image analysis software provides the projected fiber surface area and the fiber length for each fiber image recorded with the image analysis system. The fiber images can be ranked by fiber length and by fiber surface area. The use of spreadsheet software, such as Microsoft Excel version 3.0, is useful but not required to perform such data manipulation. After ranking the fibers by length, the fiber image data for those fibers having a length less than 0.25 mm is deleted. At least 500 fiber images should remain. The remaining fiber image data is then rank ordered based on projected fiber surface area, and each fiber image is assigned a number according to its ranking. The fiber image having the largest projected surface area is ranked number one.

The minimum fiber surface area as used herein can be described as follows. The number of remaining fiber images is multiplied by 0.01 (1%) to obtain a fiber image number. If the product of the multiplication is not an integer, the product should be rounded to the nearest whole number. The projected surface area of the fiber image having this number corresponds to the minimum fiber surface area.

While descriptive of the "minimum fiber surface area", this method requires a large number of images (more than 1000) to establish statistical significance. Therefore, a preferred method is recommended. This preferred method consists of obtaining the projected surface area of the remaining fiber images at the intervals 1%, 3%, 5%, 10%, and 20%. Linear regression of the projected surface area as a function of the logarithm of percentage and interpolation of the resultant function to the projected surface area at the 1% mark provides the value of minimum fiber surface area with statistical validity sufficient for the use as described herein provided sufficient fiber images are acquired to leave at least 500 fiber images after the image rejection based on fiber length described earlier.

The term "incremental surface area", as used herein, is defined as the minimum fiber surface area as determined by the preferred method described above, decreased by 0.0022 square millimeter for each percentage point of softwood contained in the specimen being considered. The correction applied to convert the minimum fiber surface area to incremental surface area compensates for the widely differing surface areas of softwoods versus hardwoods, so that a single value of surface area can be used to gage the uniformity of a pulp specimen regardless of the hardwood and softwood content of the specimen being considered. As previously discussed, uniformity in fiber properties is believed to offer benefits independent of the average properties. A pulp specimen having relatively highly nonuniform fiber properties will have a relatively high value of incremental surface area. The incremental surface area provides an index of the level of uniformity of fiber properties possessed by a given specimen of cellulose fibers.

The percentage of fines in a pulp sample can be determined by a measurement made with a Britt Dynamic Drainage Jar, Filter, and Stirring Apparatus available as Item No. DDJ#2 from Paper Research Materials of Syracuse, N.Y. For best results, it is recommended that a pulp specimen of about 1 gram dry weight be used. The fines from a fiber specimen are captured on a filter paper and weighed to determine the percentage fines in the original specimen. The drainage jar is equipped with a "125P" screen obtained from the same company; this screen has a 76.2 micron hole diameter and a 14.5% open area. The specimen can be placed directly in the jar which is then filled to within 1 inch of the top with water. To facilitate separation of the fines, 1 ml of a dispersing solution consisting of 2.5% each of sodium carbonate, sodium tripolyphosphate, and TAMOL 850 surfactant available from Rohm and Haas Company of Philadelphia, Pa., is added to the fiber and water mixture.

After stirring for 5 minutes at 1000 rpm, 500 ml of the slurry is drained into a 1000 ml beaker, and the jar is restored in volume with fresh water. The stirring is repeated in the same manner and another 500 ml is drained into the beaker. This is repeated until four beakers are filled to 1000 ml each. The fines are then captured by filtering the beakers in reverse order using a Buchner funnel, or other suitable funnel for supporting filter paper, containing a 11.0 cm Whatman glass microfiber filter #1820110, produced by Whatman International Ltd. of Maidstone, England. The filter should be pre-weighed to the nearest 0.1 mg. After filtering all four beakers of water the filter pad is removed from the funnel and dried at 105 degrees C. for one hour and cooled in a desiccator to obtain a final weight to the nearest 0.1 mg. The difference between the initial filter weight and the final filter weight is the fines weight. The fiber weight is similarly obtained by filtering the contents of the Britt Jar thorough an identical filtering and drying arrangement. The fines weight divided by the total of the fines weight and fiber weight multiplied by 100 is reported as the percentage of fines in the original specimen.

PROCEDURE

While being bound only by the claims herein, the following discussion illustrates methods of preparing cellulose fibers according to the present invention. These include the two basic arrangements of the two stage fractionating process comprising a length classifying stage and a centrifuging stage.

FIG. 1 is a flow diagram depicting one arrangement which can be used to produce cellulose pulps according to the present invention. In this arrangement, the length classifying stage is performed first, followed by the centrifuging stage.

In FIG. 1, an aqueous slurry 21 comprising wood pulp fibers is directed to form the input stream to a length classifying stage 32. A satisfactory length classifier is a centrifugal pressure screen such as a Bird "Centrisorter" manufactured by the Bird Escher Wyss Corporation of South Walpole, Mass. The slurry 21 is processed in the length classifying stage 32 to provide an accepts stream 33 of the classifying stage 32 and a rejects stream 34 of the classifying stage 32. The rejects stream 34 comprises fibers having an average fiber length exceeding that of the fibers in the accepts stream 33. The length classifying stage 32 is configured and operated as described below to provide the accepts stream 33 having an average fiber length which is at least 20%, and preferably at least 30% less than the average fiber length of the rejects stream comprising slurry 34. The fibers in rejects stream 34 are directed to alternative end uses where the characteristics sought as objectives of the present invention are less valued. In this regard they may be blended with other rejects streams, maintained separate or discarded.

Without being limited by theory, the fiber weight of the accepts stream 33 of the length classifying stage 32 should be between about 30 to 70 percent of the fiber weight of the input stream to the length classifying stage 32, so that there is about a thirty to seventy percent mass split of the fibers entering the length classifying stage 32 between the accepts stream 33 and the rejects stream 34. Such a mass split is desirable to ensure that length classifying stage 32 functions to fractionate the input stream by fiber length, rather than just functioning to remove debris such as knots and shives from the input stream.

At least a portion of the accepts stream 33 of the length classification stage 32 is directed as shown in FIG. 1 to provide an input stream 41 to a second fractionation stage comprising a centrifuging stage 42. A satisfactory centrifuging stage 42 comprises one or more hydraulic cyclones, such as 3 inch "Centricleaner" hydraulic cyclones manufactured by the CE Bauer Company of Springfield, Ohio.

For best operation of the centrifuging stage 42, it may be necessary to adjust the consistency of the input stream 41 to the centrifuging stage 42 prior to processing the input stream 41 in the centrifuging stage 42. For instance, if it is desirable to remove water from input stream 41 to increase the consistency of input stream 41, a suitable sieve 36 can be positioned intermediate the length classifying stage 32 and the centrifuging stage 42, as illustrated in FIG. 1. A suitable sieve 36 Comprises a CE Bauer "Micrasieve" equipped with a 100 micron screen.

The centrifuging stage 42 processes input stream 41 to provide an accepts stream 43 of the centrifuging stage 42 and a rejects stream 44 of the centrifuging stage 42. The accepts stream 43 exits the overflow side of the hydraulic cyclone and the rejects stream 44 exits the underflow side (the "tip") of the hydraulic cyclone.

When the process depicted in FIG. 1 is operated according to the present invention, the normalized coarseness of the fibers in accepts stream 43 is at least 3 percent, and preferably at least 10 percent less than that of the fibers in the rejects stream 44 of the centrifuging stage 42. The process depicted in FIG. 1 can be operated to provide an accepts stream 43 comprising the cellulose pulps of the present invention.

The accepts stream 43 comprising the cellulose pulps of the present invention includes at least 10 percent softwood fibers, has an incremental surface area less than 0.085 square millimeters, and has a coarseness related to average fiber length by the algebraic expression recited above. The average fiber length of the accepts stream 43 is preferably about 0.70 mm to about 1.1 mm, and more preferably about 0.75 mm to about 0.95 mm to provide this coarseness to fiber length relationship.

The fiber weight of the accepts stream 43 of the centrifuging stage 42 should be between about 30 to 70 percent of the fiber weight of the input stream 41 to the centrifuging stage 42, so that there is about a thirty to seventy percent mass split of the fibers entering the centrifuging stage 42 between the accepts stream 43 and the rejects stream 44, respectfully. Such a mass split is desirable to ensure that the centrifuging stage 42 provides an accept stream 43 having a reduced normalized coarseness relative to rejects stream 44, rather than just functioning to remove debris such as knots and shives from the input stream 41.

Figure 2:
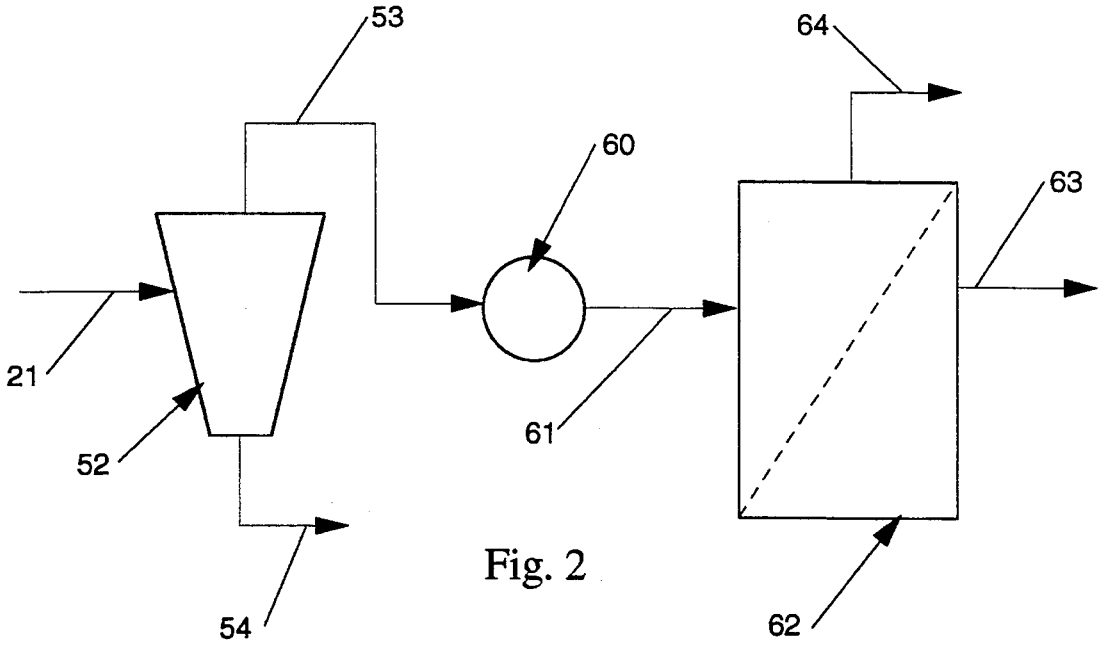
FIG. 2 is a schematic flow diagram depicting an alternate method of practicing the current invention wherein a centrifuging stage is performed first, followed by a length classification stage.

FIG. 2 is a flow diagram depicting another arrangement which can be used to produce cellulose pulps according to the present invention. In this arrangement, the centrifuging stage is performed first, followed by the length classifying stage.

In FIG. 2, an aqueous slurry 21 comprising wood pulp fibers is first directed to form the input stream to the centrifuging stage 52. The centrifuging stage 52 comprises at least one hydraulic cyclone. The centrifuging stage 52 processes the input stream to provide an accepts stream 53 of the centrifuging stage 52 and a rejects stream 54 of the centrifuging stage 52. The accepts stream 53 exits the overflow side of the hydraulic cyclone, and the rejects stream exits the under flow side (the tip) of the hydraulic cyclone. When operated according to the present invention, the normalized coarseness of the fibers in accepts stream 53 is at least 3 percent, and preferably at least 10 percent less than that of the fibers in the rejects stream 54 of the centrifuging stage 52, and the average fiber length of the fibers in the accepts stream 53 is preferably about equal to or greater than that of the slurry 21.

At least a portion of the accepts stream 53 of the centrifuging stage 52 is directed to provide an input stream 61 to a length classifying stage 62. The length classifying stage 62 can comprise a screen, such as the centrifugal screen described above. It may be desirable to adjust the consistency of the input stream 61 prior to processing the input stream 61 in the length classifying stage 62. For instance, if it is desirable to remove water from input stream 61 to increase its consistency, a suitable sieve 60 can be positioned intermediate the centrifuging stage 52 and the length classifying stage 62 as illustrated in FIG. 2. A suitable sieve 60 comprises a CE Bauer "Micrasieve" equipped with a 100 micron screen.

The length classifying stage 62 processes input stream 61 to provide an accepts stream 63 of the length classifying stage and a rejects stream 64 of the length classifying stage. The rejects stream 64 comprises fibers having an average fiber length exceeding that of the fibers in the accepts stream 63. The average fiber length is at least 20 percent less, and preferably at least 30 percent less than the average fiber length of the rejects stream 64 to the length classification stage.

The process depicted in FIG. 2 can be operated to provide an accepts stream 63 comprising the cellulose pulps of the present invention. The accepts stream 63 comprising the cellulose pulps of the present invention includes at least 10 percent softwood fibers, has an incremental surface area less than 0.085 square millimeters, and has a coarseness related to average fiber length by the algebraic expression recited above. The average fiber length of the accepts stream 63 is preferably about 0.7 mm to about 1.1 mm, and more preferably about 0.75 mm to about 0.95 mm to provide the aforementioned coarseness to fiber length relationship.

The operating parameters of the length classification and centrifuging stages can be adjusted for the specific characteristics of the fibers contained in slurry 21 in order to achieve the necessary change in the average fiber length and normalized coarseness respectively required by the present invention. For the embodiment wherein the length classification stage comprises a centrifugal screen, such operating parameters include the consistency of the input and output slurry; the size, shape, and density of perforations in the screen media; the speed at which the screen pulsator rotates; and the flow rates of the inlet and each of the outlet streams.

It may also be desirable to use dilution water to aid in the removal of the longer fiber rejects stream from the screen in the sieve 60 if it tends to be excessively thickened by the action of the screen. For the embodiment wherein the centrifuging stage comprises a hydraulic cyclone, examples of operating parameters include the consistency of the input stream, the diameter of the cone, the cone angle, the size of the underflow opening, and the pressure drop from the inlet slurry to each leg of the outlet.

EXAMPLES

To facilitate the practice of the invention the following illustrative examples are provided:

Example 1

This example illustrates one method of preparing cellulose pulps according to the present invention by sequentially length classifying and centrifuging an input slurry formed from a recycled pulp. References in this example correspond to FIG. 1.

A recycled pulp is obtained from the Ponderosa Pulp Company of Oshkosh Wis. It is described by the vendor as deinked pulp from 100% post consumer waste paper. The typical characteristics of this pulp are: 1.12 mm fiber length, 15.8% fines, 50–55% moisture. Ordinary well water is used for all of the dilution in the following example. Ambient temperature is 50–80 degrees F. over the period during which this work is taking place.

The following steps are employed leading to the preparation of an aqueous slurry 21. Wet lap pulp is charged to a 5 foot HICON Hydrapulper manufactured by Black Clawson of Middletown, Ohio, where separate batches are repulped in about 400 pound quantities at 10–12% consistency for 10–15 minutes. Dilution to pumpable consistency occurs at the pulper exit and the resulting slurry at about 3% consistency is taken to a holding tank.

The slurry is then directed to a Bauer Micrasieve (Model 522-1 with a 100 micron wire spacing) manufactured by the CE Bauer Company. The flow rate is 260 gpm and the consistency is 2.8%. Rejects enriched in fines are discarded while the accepts are returned to another holding tank. This procedure is repeated for a total of three passes through the Micrasieve so that the fines content of the pulp is at 5.4%. Alternatively, the fines can be removed in a sieve 36, such as a Bauer Micrasieve, disposed between the length classification stage 32 and the centrifuging stage 42.

The pulp is diluted to 1% in its holding tank to provide the aqueous slurry 21 of FIG. 1. It is analyzed and found to have an average fiber length of 1.16 mm and a coarseness of 1.36 mg/10 m. It is pumped to a length classifier 32, in the form of a Bird Centrisorter (Model 100) manufactured by the Bird Escher Wyss Company. The Centrisorter is driven by a 50 hp 1750 rpm motor through a pulley which imparts a radial velocity of 2200 rpm to the Centrisorter pulsator. The Bird Centrisorter screen hole size is 0.032" at 12% open area. The rejects dilution line water is about 28 gpm. The slurry 21 is conveyed to the Centrisorter at 260 gpm. The rejects stream 34 is removed from the Centrisorter at 40 gpm and the accepts stream 33 is removed from the Centrisorter at 248 gpm.

The cellulose pulp fiber mass in accepts stream 33 is measured and found to comprise 55.8% of the fiber mass of the cellulose pulp in the input stream comprising aqueous slurry 21. The rejects stream 34 is analyzed and found to have a fiber length of 1.55 mm and a coarseness of 1.62 mg/10 m before disposal. The accepts stream 33 is analyzed and found to have an average fiber length of 0.94 mm and a coarseness of 1.26 mg/10 m and taken to a holding tank.

The accepts stream 33 is diluted to 0.1% consistency and pumped to centrifuging stage 42 in the form of a bank of 10 Bauerlite Model 600-22, 3 inch liquid hydraulic cyclones having a cone angle of five degrees, ten minutes and manufactured by the CE Bauer Company. The underflow section of each is equipped with an outlet tip diameter of 5/32 inch. The bank of hydraulic cyclones is fed at a total rate of 241 gpm. The pressure of the inlet stream 41 of the bank is 70 psig. The pressure of the accepts stream 43 at the overflow outlet is 16.5 psig. The rejects stream 44 at the underflow outlet (tip) discharges directly into atmospheric pressure. The cellulose pulp in the accepts stream 43 is measured and found to comprise 54% of the fiber mass of the input stream 41. The fibers in rejects stream 44 (comprising 46% of the mass of the fibers in input stream 41) are found to have an average fiber length of 0.94 and a coarseness of 1.31 mg/10 m before disposal.

The accepts stream 43 contains fibers meeting the requirements of the present invention as demonstrated by the following applicable measurements:

Percent Softwood: 24%
Coarseness: 1.23 mg/10 m
Average Fiber Length: 0.92 mm
Minimum Fiber Surface Area: 0.130 square millimeters Using these measurements, the incremental surface area can be calculated as $0.130-24^* 0.0022=0.077$ square millimeters. The threshold coarseness can be calculated as followed:

$C<(L)^{0.3}+0.3$
$C<(0.92)^{0.3}+0.3$
$C<0.98+0.3$
$C<1.28$

Since the observed coarseness of 1.23 mg/10 m is lower than the threshold coarseness, the cellulose pulp made according to this process meets the requirements of the present invention.

Example 2

This example illustrates another method of preparing cellulose pulps according to the present invention by sequentially centrifuging and length classifying an input slurry formed from a recycled pulp. References in this example correspond to FIG. 2 which depicts the process arrangement.

The same recycled pulp used in Example 1 is used in this Example. Again, ordinary well water is used and the ambient temperature is 50–80 degrees F. over the period during which this work is taking place. The steps taken in the preparation of slurry 21 are identical to those in Example 1. The slurry 21 is pumped from its holding tank where it is stored at 1% consistency and is diluted in-line to 0.1% consistency and pumped to provide an input stream to centrifuging stage 52. The centrifuging stage 52 comprises a bank of 10 Bauerlite Model 600-22, 3 inch liquid hydraulic cyclones having a cone angle of 5 degrees, 10 minutes and manufactured by the CE Bauer Company. The underflow section of each hydraulic cyclone is equipped with an outlet tip diameter of 5/32 inch. The bank of hydraulic cyclones is fed at a total rate of 249 gpm. Pressure in the inlet stream to the bank of hydraulic cyclones is 69 psig. Pressure in the accepts stream 53 at the overflow outlet is sensed at 10 psig and rejects stream 54 at the underflow (tip) discharges directly to atmospheric pressure. The rejects stream 54 is analyzed and found to have an average fiber length of 1.09 mm and a coarseness of 1.42 mg/10 m before disposal.

The accepts stream 53 is directed to provide an input stream 61 to the length classification stage 62 comprising a Bird Centrisorter (Model 100) identical to that used in Example 1. Since the accepts stream 53 is diluted by the centrifuging stage 52, accepts stream 53 is passed over a sieve 60 comprising the Bauer Micrasieve described above to provide an input stream 61 having a consistency between 2 and 3 percent. Sieve 60 also alters the fiber characteristics in accepts stream 53 because some fibers are removed from the water exiting the Micrasieve. The accepts stream 53 prior to sieve 60 contains fibers having an average fiber length of 1.21 mm and a coarseness of 1.36 mg/10 m. The input stream 61 exiting the sieve 60 has an average fiber length of 1.35 mm and a coarseness of 1.45 mg/10 m. The input stream 61 is taken to a holding tank.

The input stream 61 is diluted to 1% consistency in line, and directed at 260 gpm to the length classification stage 62 comprising the Bird Centrisorter described above. Rejects dilution water is set at about 27 gpm. The rejects stream 64 is removed from the Centrisorter at 34 gpm and the accepts stream 63 is removed from the Centrisorter at 253 gpm. The accepts stream 63 is analyzed and found to comprise 47.5% of the fiber mass of the cellulose pulp in input stream 61. The rejects stream 64 is analyzed and found to have an average fiber length of 1.73 mm and a coarseness of 1.66 mg/10 m before disposal.

The accepts stream 63 contains fibers meeting the requirements of the present invention as demonstrated by the following applicable measurements.

Percent Softwood: 29%
Coarseness: 1.19 mg/10 m
Average Fiber Length: 1.02 mm
Minimum Fiber Surface Area: 0.138 square millimeters The incremental surface area can be calculated as:

$$0.138-29*0.0022=0.074 \text{ square millimeters.}$$

The threshold coarseness can be calculated as followed:

$$C<(L)^{0.3}+0.3$$
$$C<(1.02)^{0.3}+0.3$$
$$C<1.01+0.3$$
$$C<1.31$$

Since the observed coarseness of 1.19 mg/10 m is lower than the threshold coarseness, the cellulose pulp made according to this process meets the requirements of the present invention.

The cellulose pulps of the present invention are suitable for use in a wide variety of papers and papermaking processes. U.S. Pat. Nos. 4,191,609, 4,528,239 and 4,637,859 issued to Trokhan on Mar. 4, 1980, Jul. 9, 1985 and Jan. 20, 1987, respectively, are incorporated herein by reference for the purpose of showing a method for making tissue paper. The cellulose pulps of the present invention are particularly suitable for use in making tissue paper, such as single ply tissue paper having a density less than 0.15 gram per cubic centimeter and a basis weight between about 16.3 to about 35.9 grams per square meter (about 10 to about 22 pounds per 3000 square feet). The density value is determined by measuring the apparent thickness using a 12.9 square centimeters (2 square inch) plate exerting a force of 5.0 grams per square centimeter (0.07 pounds per square inch). The thickness of a stack of five plies of paper is measured and the result divided by five to determine the apparent thickness of a single ply. The density can then be calculated from the apparent thickness and the basis weight.

Such tissue paper should be formed of fibers having low coarseness to meet coarseness softness expectations. However, it is difficult to achieve requisite strength in such papers because of the low fiber-to-fiber contact area resulting from the low density and basis weight of such paper, and because of the typically short fibers used in such papers to meet softness requirements. The pulps of the present invention overcome these limitations by providing tissue papers having reduced coarseness for a given fiber length.

It will be appreciated that the foregoing examples, shown for purposes of illustration, are not to be construed as limiting the scope of the present invention, which is defined in the following claims.

What is claimed is:

1. A cellulose pulp having improved softness potential, said pulp comprised of wood fibers, the pulp containing at least ten percent softwood fibers and the pulp having a fiber incremental surface area less than 0.085 square millimeters and a fiber coarseness that is related to the average fiber length by the relation:

$$C<(L)^{0.3}+0.3$$

wherein C is the fiber coarseness measured in milligrams of fiber weight per 10 meters of fiber length, and L is the average fiber length in millimeters, and wherein L is between about 0.70 millimeter and about 1.1 millimeter.

2. The cellulose pulp of claim 1 wherein said wood fibers have an average fiber length of from about 0.75 millimeter to about 0.95 millimeter.

3. The cellulose pulp of claim 1 wherein the cellulose pulp comprises at least twenty percent softwood fibers.

4. The cellulose pulp of claim 3 wherein the cellulose pulp comprises between twenty and forty percent softwood fibers.

5. The cellulose pulp of claim 3 wherein the cellulose pulp comprises recycled wood fibers.

6. The cellulose pulp of claim 5 wherein the cellulose pulp comprises recycled ledger paper fibers.

7. The cellulose pulp of claim 1 wherein said cellulose pulp comprises a chemical pulp having a lignin content of less than about 5 percent by weight of the fiber weight of the cellulose pulp.

8. The cellulose pulp of claim 7 wherein the cellulose pulp comprises recycled wood fibers.

* * * * *